US009615711B2

(12) United States Patent
Stein et al.

(10) Patent No.: US 9,615,711 B2
(45) Date of Patent: Apr. 11, 2017

(54) FLOOR CARE APPLIANCE

(71) Applicant: Stein & Co. GmbH, Velbert (DE)

(72) Inventors: Thomas Stein, Velbert (DE); Hartmut Boll, Velbert (DE)

(73) Assignee: STEIN & CO. GmbH, Velbert (DE)

( * ) Notice: Subject to any disclaimer, the term of this patent is extended or adjusted under 35 U.S.C. 154(b) by 85 days.

(21) Appl. No.: 14/704,024

(22) Filed: May 5, 2015

(65) Prior Publication Data

US 2015/0320282 A1 Nov. 12, 2015

(30) Foreign Application Priority Data

May 6, 2014 (DE) ..... 10 2014 006 680
Jul. 8, 2014 (DE) ..... 10 2014 010 151
Nov. 6, 2014 (DE) ..... 10 2014 016 472

(51) Int. Cl.

*A47L 9/28* (2006.01)
*A47L 9/04* (2006.01)
*A47L 9/14* (2006.01)
*A47L 5/30* (2006.01)

(52) U.S. Cl.

CPC ..... *A47L 9/2857* (2013.01); *A47L 5/30* (2013.01); *A47L 9/0411* (2013.01); *A47L 9/0444* (2013.01); *A47L 9/0477* (2013.01); *A47L 9/14* (2013.01); *A47L 9/2831* (2013.01); *A47L 9/2847* (2013.01); *A47L 9/2889* (2013.01)

(58) Field of Classification Search

CPC ..... A47L 9/2857; A47L 5/30; A47L 9/2831; A47L 9/0411; A47L 9/0444; A47L 9/2889; A47L 9/2847; A47L 9/0477; A47L 9/14

IPC ..... A47L 9/28

See application file for complete search history.

(56) References Cited

U.S. PATENT DOCUMENTS 4,099,291 A * 7/1978 Bowerman ..... A47L 5/30 15/390
4,531,249 A * 7/1985 Sternberg ..... A47L 9/0411 15/52.1
5,056,175 A 10/1991 Stein et al.
(Continued)

FOREIGN PATENT DOCUMENTS

DE 3204272 8/1983

OTHER PUBLICATIONS

German Search Report, Nov. 6, 2014.
EP Search Report for related application No. EP 15 16 6359, dated Oct. 5, 2015.

*Primary Examiner* — David Redding
(74) *Attorney, Agent, or Firm* — Greer Burns & Crain, Ltd.

(57) ABSTRACT

A brush vacuum cleaner having a safety shutdown of the drive via an overload brush roller torque detection. A mechanical triggering element via transmission elements actuates an electrical switch for the main switch to shut down the drive above a torque threshold. The switch is additionally connected in parallel by an external actuating element to an on and off position by a spring-loaded control element and a coupling element. Due to the control element, switching the switch into an off position due to overload is transmitted to the actuating element that can be adjusted into an off position. The control element is spring held in the on position in an arrangement for the engagement of the control element, where an unlocking can be set as off position by adjustment of the control element via the actuating element against the spring pressure.

11 Claims, 6 Drawing Sheets

(56) References Cited

U.S. PATENT DOCUMENTS

2012/0324674 A1 12/2012 Dant et al.

* cited by examiner

Fig. 5
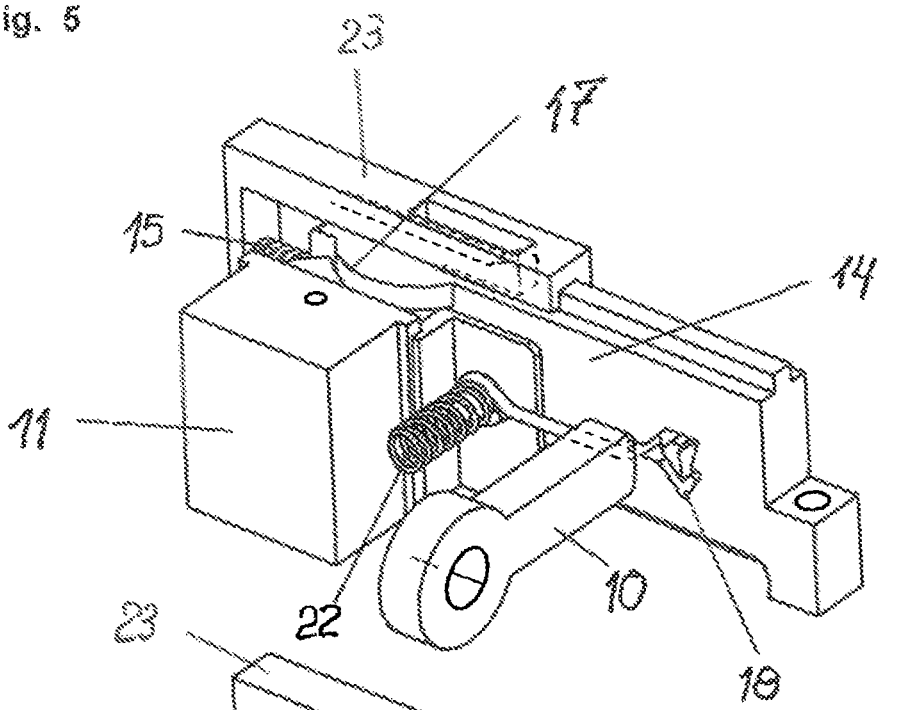
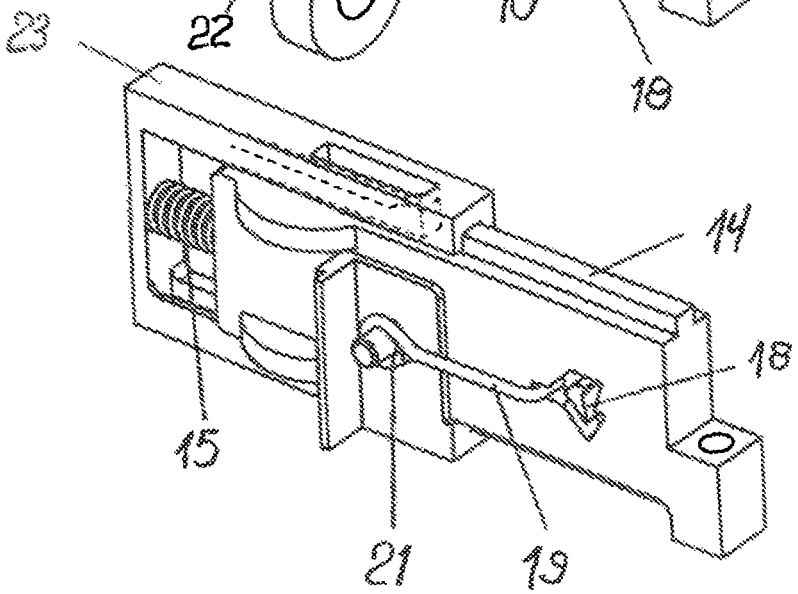
Fig. 6

Fig. 9
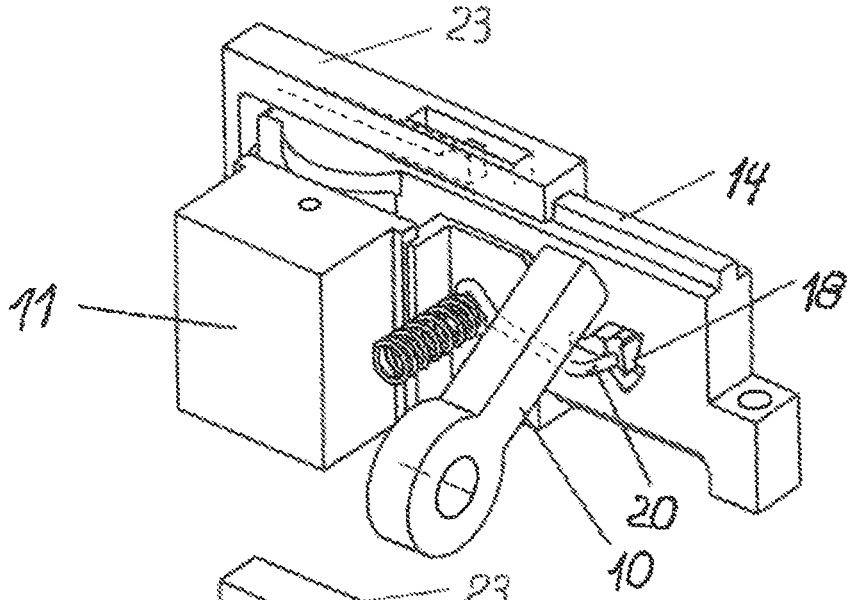
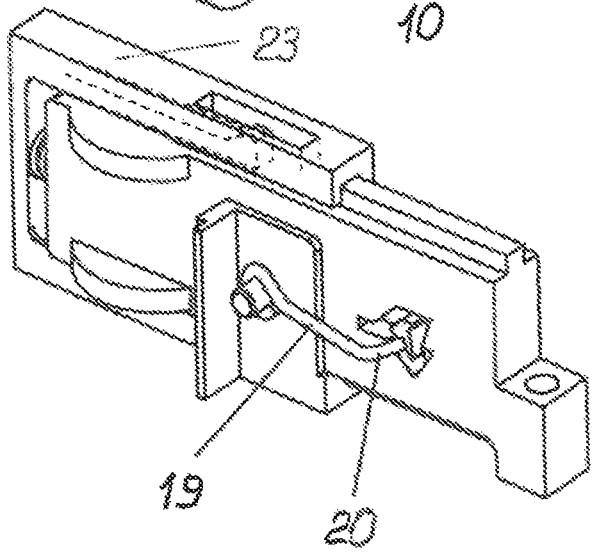
Fig. 10

FLOOR CARE APPLIANCE

CROSS-REFERENCES TO RELATED APPLICATIONS

This application claims the benefit of the German patent application No. 10 2014 016 472.1 filed on Nov. 6, 2014, of the German patent application No. 102014 006 680.0 filed on May 6, 2014, and of the German patent application No. 10 2014 010 151 .7 filed on Jul. 8, 2014, the entire disclosures of which are incorporated herein by way of reference.

BACKGROUND OF THE INVENTION

The invention relates to a floor care appliance in the form of a brush vacuum cleaner having a brush set facing the floor for receiving a driven brush roller with an overload protection, where the brush set can be connected by means of a pivotable connecting element in the form of a connecting piece for an attachable guide element in the form of a hand grip to a handle and dust collecting device via corresponding connections, where at least one electric motor is provided as drive for a suction fan and as drive for the brush roller, and where the brush roller is assigned a unit for detecting the torque and a shutdown of the drive is accomplished by means of a switch controlled by the torque detection when a torque threshold is exceeded in the event of overload.

It is known to configure safety devices for brush vacuum cleaners which carry out a mechanical or electronic decoupling in the event of overload and blocking of the driven brush roller. In this case it is provided either to perform an electronic shutdown by slippage of a non-positively arranged belt for driving by a built-in slip or ratchet coupling with a controller which monitors the power of the drive or to perform an electronic shutdown by means of a torque measurement and evaluation by microcontrollers with subsequent electronically triggered shutdown of the electrical drive. In particular in devices having only one motor for fan and brush drive, this can only be solved in a very complex and cost-intensive manner in order to ensure a long stability and operating safety. In addition, there is the shortcoming that in addition to the controlled shutdown devices, an additional switch is always required as main switch and a relatively high expenditure for electronic controls is given. An exemplary floor care appliance is disclosed in the document U.S. Pat. No. 5,056,175 A of the applicant.

SUMMARY OF THE INVENTION

It is an object of the invention to enable a circuit arrangement with an internal electrical switch for a generic brush vacuum cleaner with a shutdown in the event of overload and to ensure a mechanical switching facility for an on-off position from outside.

The solution of this object is accomplished according to the invention whereby a movable spring-loaded control element actuates an electrical switch and engages in the tensioned position, where an external actuating element is coupled to the control element and the control element engages by operation of the actuating element and the electrical switch is closed in the tensioned position and open in the stress-relieved position and the unit for torque detection controls a mechanical triggering element and releases the engagement of the control element, where the spring tension moves the control element and opens the electrical switch.

It is thereby possible to switch the electrical switch by an external mechanical actuating element disposed on the brush set and set the actuating element into an off position independently of this in the event of an overload shutdown.

Here it is provided that in the engaged state of the control element the engagement can be released by operation of the actuating element.

It is further proposed that the spring-loaded control element is disposed in a fixed guide and the control element is connected to the actuating element via a coupling element.

It is further proposed that both end positions of the actuating element are configured as on and off positions.

It is additionally proposed that the control element is mounted translationally.

Alternatively it is provided that the control element is mounted rotationally.

An advantageous arrangement consists in that the arrangement for the engagement is configured as a link element in the control element, in which a fixedly mounted locking element such as a hook engages and the locking element receives the force of the spring—first spring—via a positive connection and the locking element is held by means of an appurtenant spring—second spring—in guide tracks of the link element and is guided depending on the direction of movement of the control element, wherein a guide track feeds the locking element to a stop of the link element and a further guide track is used for release of the locking element, and that for the overload shutdown the locking element in an additional degree of freedom can be raised from the stop of the link element by the spring of the control element against the force of the spring of the locking element, and the additional degree of freedom of the locking element runs substantially transversely to the direction of force of the spring of the control element and the additional degree of freedom of the locking element can be released by the switch element of the unit for torque detection.

A simple configuration is created whereby the locking element is formed from a wire in the form of a hook which has an eye at one end for fixed mounting and on the other side has a bent end for engagement in the link element.

For this purpose it is further proposed that the locking element has the associated spring in the region of the linkage, which presses the bent end into the link element.

It is further provided that the electrical switch is disposed as the main switch of the floor care appliance.

A further embodiment consists in that the on and off position is each assigned its own switch for the switchover function.

BRIEF DESCRIPTION OF THE DRAWINGS

An exemplary embodiment of the invention is shown schematically in the drawings. In the figures:

FIGS. 5 and 6 show a schematic diagram of a control rod with a link element as locking arrangement in an off position of the main switch;

FIGS. 7 and 8 show a schematic diagram according to FIGS. 5 and 6 in an on position and FIGS. 9 and 10 show a schematic diagram according to FIGS. 5 and 6 after a safety shutdown.

DETAILED DESCRIPTION OF THE PREFERRED EMBODIMENTS

Figure 1:
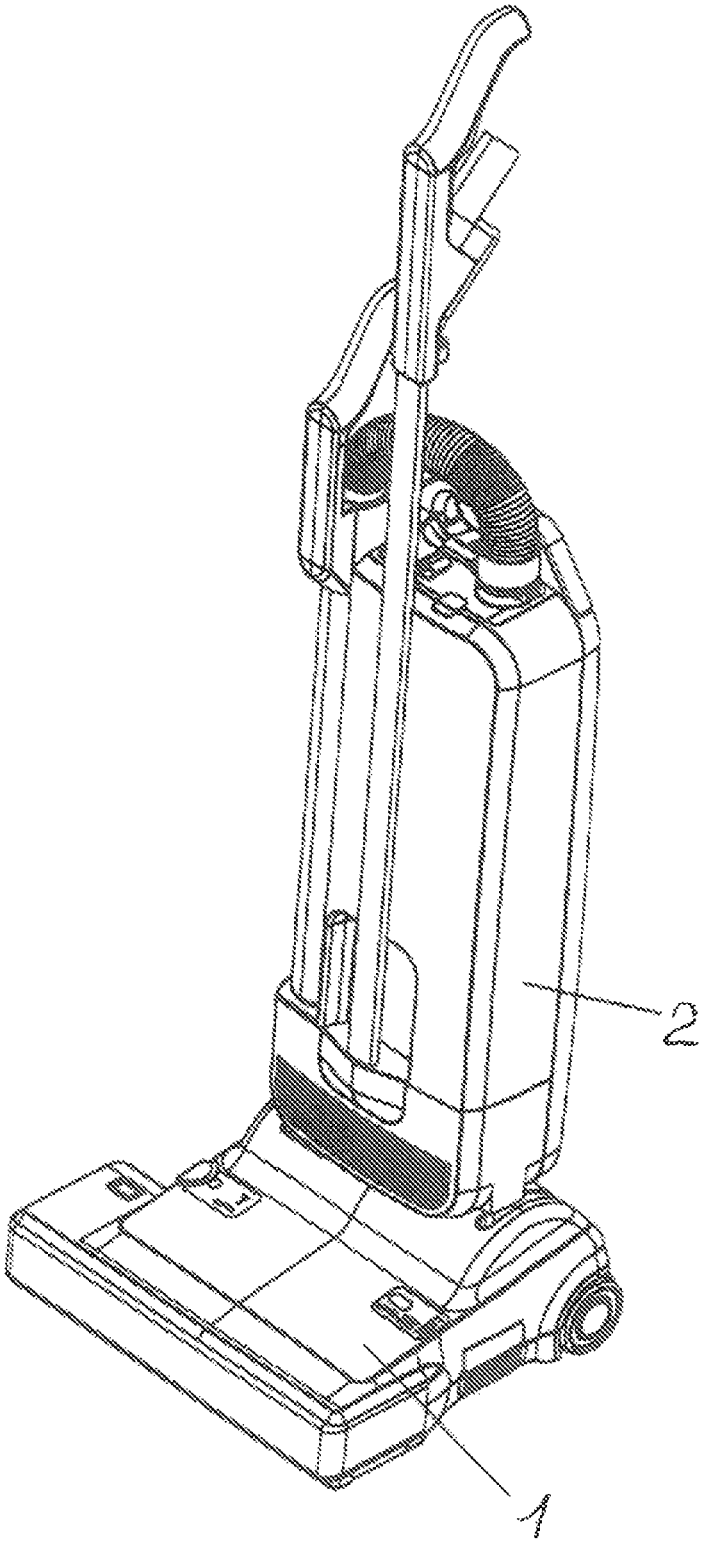
FIG. 1 shows a brush vacuum cleaner with a brush set and a filter housing placed thereon.
Figure 2:
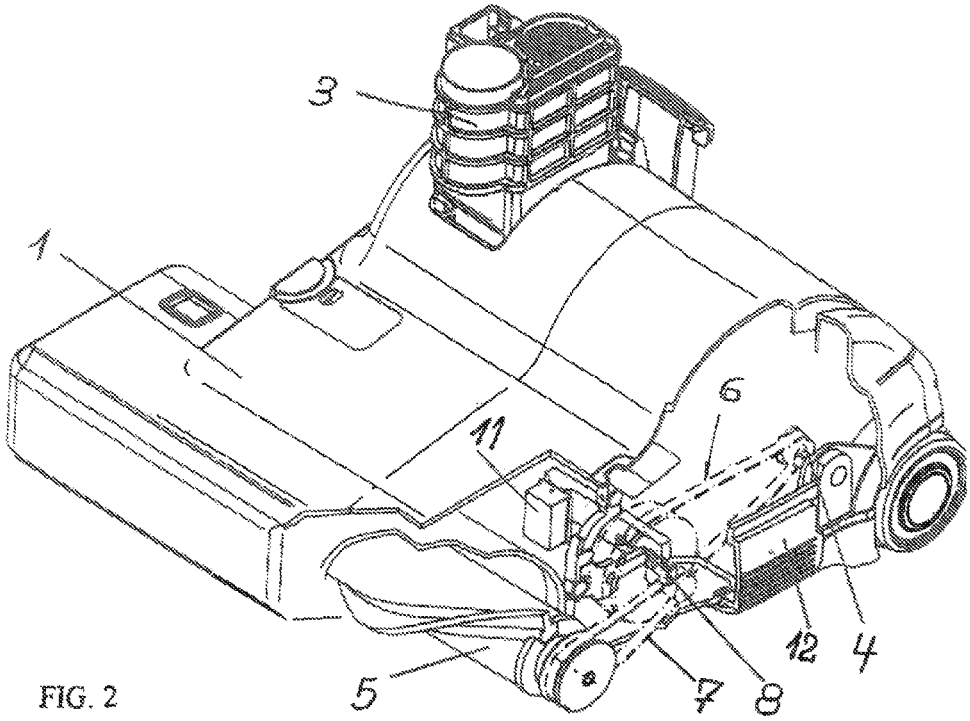
FIG. 2 shows a brush set in perspective view with torque detection and switching elements.
Figure 3:
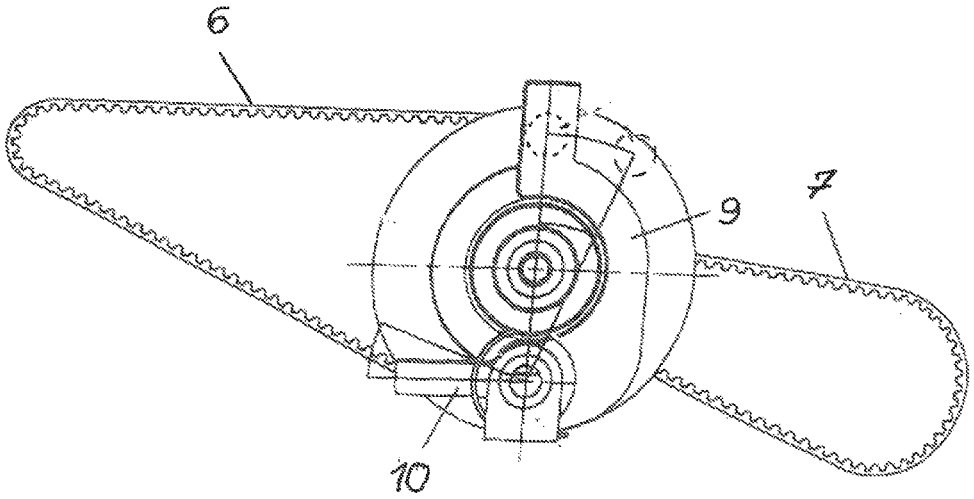
FIG. 3 shows a side view of an eddy current disk of a unit for torque detection with associated pivotable lever for shutdown.
Figure 4:
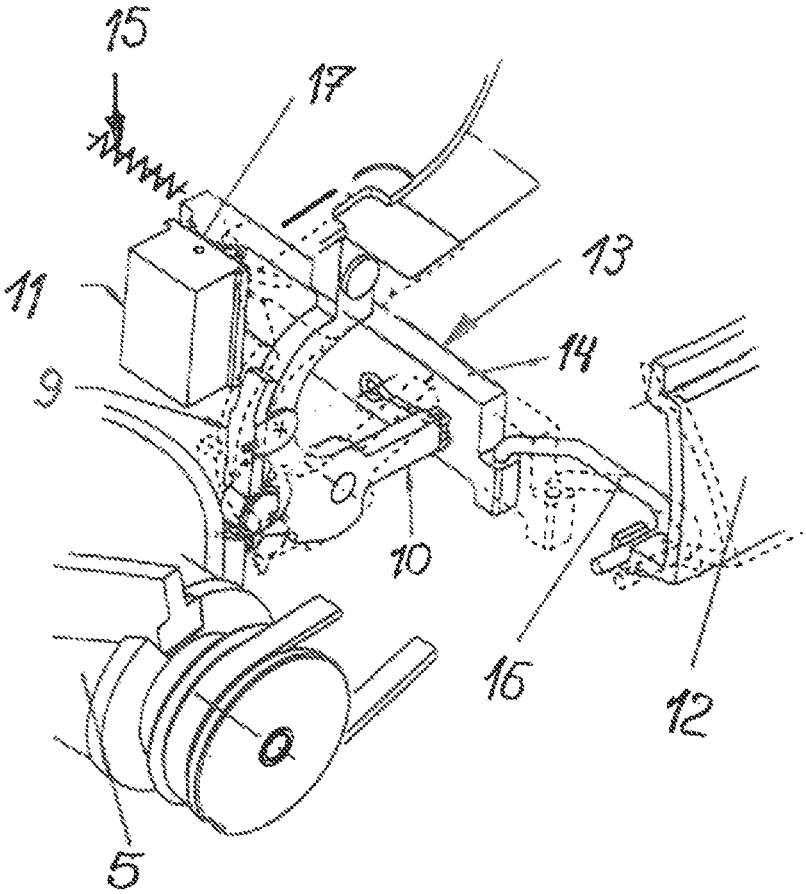
FIG. 4 shows a diagrammatic view of transmission elements with controllable main switch and external actuating element.
Figure 7:
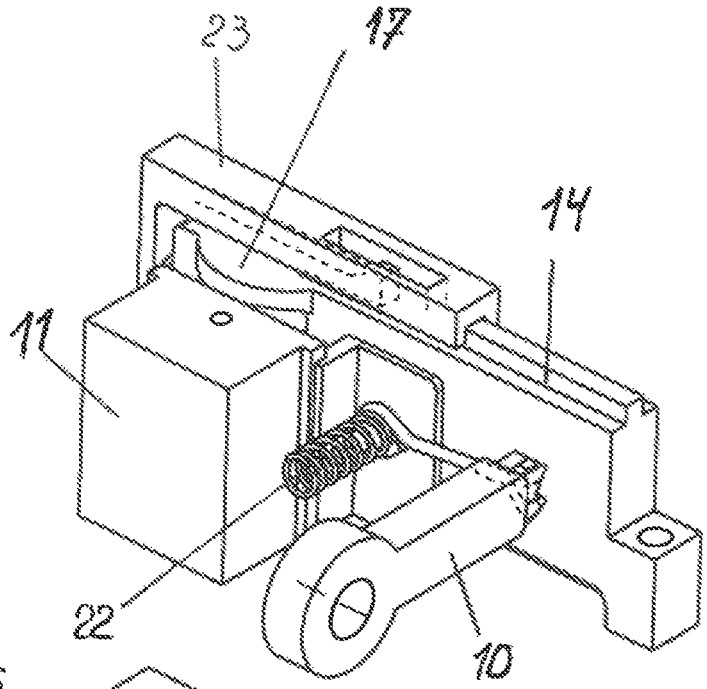
Figure 8:
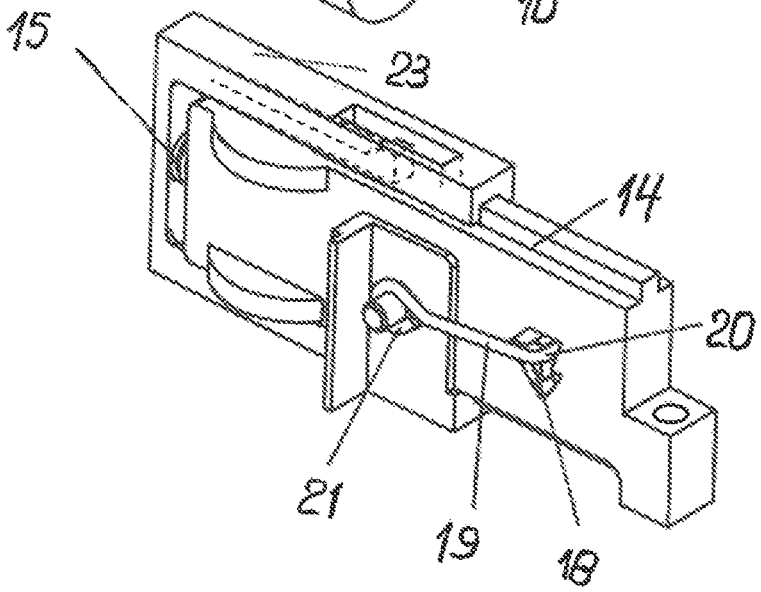

In a brush vacuum cleaner a brush set 1 is connected by means a pivotable connecting element 3 in the form of a connecting piece to an attachable filter housing 2. The brush set 1 has an electrical drive 4 for a brush roller 5 via a drive train 6, 7 and at the same time for a suction fan not shown in detail.

A unit 8 for torque detection is located in the drive train 6, 7. In this case, when a torque threshold is exceeded, by means of a pivotable lever 9, a lever arm 10 is actuated via a triggering mechanism and by transmission elements 13 with a spring-loaded switching element or control element 14 an electrical switch 11 is actuated for shutting down the drive 4. In this case, the pivotable lever 9 is triggered by means of an eddy current disk where the lever 9 bears a magnet. Naturally other types of triggering of the lever arm 10 are also possible.

The switch 11 is additionally switchable in parallel by an external actuating element 12 with an on and off position on the external part of the brush set 1, where by means of the spring-loaded switching element 14 and a coupling element 16 the switching position of the switch 11 is transmitted to the actuating element 12 in the event of shutdown above a torque threshold due to overload and the on position can be reset.

The control element 14 in the form of a control rod is located by means of a fixed carriage guide 23 which is acted upon by an associated spring 15, where the control element 14 can be set by the spring 15 in the direction of an off position of the switch 11. The control element 14 is in this case connected via the coupling element 16 for connection to the external actuating element 12 and therefore the pivotably arranged actuating element 12 is connected to the control element 14 and an on and off position can be transmitted to the switch 11.

In order to execute the aforesaid switching movements, the control element 14 has a corresponding control cam 17 to the switch 11 as rocker switch which performs the switching on or off of the drive 4 according to the position of the control element 14.

The guided control element 14 is set by the spring 15 into the off position of the main switch 11 and is connected via the coupling element 16 to the external actuating element 12. The off position is limited by a locking arrangement formed as a link element 18 of the control element 14, where a fixedly mounted locking element in the form of a hook element 19 engages with its bent end 20 in the link element 18 and is limited. For this purpose the hook element 19 is fixed for mounting by means of an eye 21 and is held acted upon by a spring 22 and engages with its bent end 20 in a guide track of the link element 18. In an on position which can be set by means of the actuating element 12, the control element 14 is displaced against the force of the spring 15 and the hook element 19 is held by means of a guide track in the link element 18 by means of a stop. During these switching movements the hook element 19 is held by means of the associated switch element 10 in the link element 18 with its guide tracks.

In a safety shutdown, the switch element 10 releases the guide tracks of the link element 18 so that the hook element 19 jumps from the link element 18 and consequently the control element 14 can be set by the spring 15 into an off position. The actuating element is therefore also set into the off position.

For a brush vacuum cleaner having a safety shutdown of the drive by means of torque detection of the brush roller in the event of overload, it is provided that a mechanical triggering element by means of transmission elements actuates an electrical switch for the main switch for shutdown of the drive above a torque threshold. In this case, the switch is additionally connected in parallel by an external actuating element to an on and off position by a spring-loaded control element and a coupling element, wherein as a result of the spring-loaded control element the switching position of the switch into an off position due to overload is transmitted to the actuating element that can be adjusted into an off position. The on and off position of the main switch is adjustable in parallel by the actuating element. The control element is here held in the on position by the associated spring in an arrangement for the engagement of the control element, where an unlocking can be set as off position by adjustment of the control element by means of the actuating element against the pressure of the spring.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner comprising:

a brush set facing the floor for receiving a driven brush roller with an overload protection, the brush set being connected via a pivotable connecting element in the form of a connecting piece for an attachable guide element in the form of a handle to a hand grip and dust collecting device via corresponding connections, at least one electric motor being provided as a drive for a suction fan and as a drive of the brush roller, a brush roller drive train having a torque detecting unit and a shutdown of the drive being accomplished via an electrical switch controlled by the torque detection unit when a torque threshold is exceeded in the event of overload, a control element configured to be movable via a first spring actuating the electrical switch and engaging in a tensioned position, an external actuating element being coupled to the control element and the control element engaging by operation of the actuating element, the electrical switch being closed in a tensioned position of the first spring and open in a stress-relieved position, the torque detection unit controlling a mechanical triggering element and releasing the engagement of the control element, and the spring tension moving the control element and opening the electrical switch.

2. The floor care appliance according to claim 1, wherein in the engaged state of the control element the engagement is releasable by operation of the actuating element.

3. The floor care appliance according to claim 1, wherein the spring-loaded control element is disposed in a fixed guide and the control element is connected to the actuating element via a coupling element.

4. The floor care appliance according to claim 1, wherein the actuating element has two end positions configured as on and off positions, respectively.

5. The floor care appliance according to claim 1, wherein the control element is mounted translationally.

6. The floor care appliance according to claim 1, wherein the control element is mounted rotationally.

7. The floor care appliance according to claim 1, wherein the arrangement for the engagement is configured as a link element in the control element, in which a fixedly mounted locking element engages and the locking element receives the force of the first spring via a positive connection and the locking element is held by means of an appurtenant second spring in guide tracks of the link element and is guided depending on the direction of movement of the control element, wherein a guide track feeds the locking element to a stop of the link element and a further guide track is configured to release the locking element, wherein for the overload shutdown, the locking element, in an additional degree of freedom, can be raised from the stop of the link element by the first spring of the control element against the force of the second spring of the locking element, wherein the additional degree of freedom of the locking element runs substantially transversely to the direction of force of the first spring of the control element and the locking element is configured to be released by the switch element of the unit for torque detection.

8. The floor care appliance according to claim 1, wherein the locking element is formed from a wire in the form of a hook which has an eye at one end or a fixed mounting and on the other side has a bent end for engagement in the link element.

9. The floor care appliance according to claim 8, wherein the locking element has the associated second spring in a region of the linkage, which presses the bent end into the link element.

10. The floor care appliance according to claim 1, wherein the electrical switch is disposed as the main switch of the floor care appliance.

11. The floor care appliance according to claim 4, wherein the on and off position is each assigned its own switch for the switchover function.

* * * * *